United States Patent [19]

Enk

[11] Patent Number: 4,779,683

[45] Date of Patent: Oct. 25, 1988

[54] DISCHARGE CONTROL HEAD FOR AIRCRAFT FIRE EXTINGUISHANT CONTAINERS

[76] Inventor: William A. Enk, 1213 Horizon, Blue Springs, Mo. 64015

[21] Appl. No.: 534,493

[22] Filed: Sep. 21, 1983

[51] Int. Cl.[4] ..... A62C 31/02; A62C 35/12; A62C 37/18

[52] U.S. Cl. ..... 164/67; 169/62; 169/28; 169/74; 169/75; 169/89

[58] Field of Search ..... 169/23, 26, 28, 30, 169/53, 60–62, 74, 75, 89

[56] References Cited

U.S. PATENT DOCUMENTS

| | | | |
|---|---|---|---|
| 2,563,837 | 8/1951 | Grant, Jr. | 169/62 |
| 3,552,495 | 1/1971 | Fiero | 169/28 |
| 3,735,376 | 5/1973 | Kramer et al. | 169/23 |
| 3,762,479 | 10/1973 | Fike, Sr. et al. | 169/62 |
| 3,809,163 | 5/1974 | Weise | 169/26 |
| 4,023,164 | 5/1977 | Delaney | 169/23 |
| 4,126,184 | 11/1978 | Hinrichs | 169/28 X |

*Primary Examiner*—Andres Kashnikow
*Assistant Examiner*—Mary Beth O. Jones
*Attorney, Agent, or Firm*—Kokjer, Kircher, Bradley, Wharton, Bowman & Johnson

[57] ABSTRACT

A control head for controlling the discharge of pressurized extinguishing agent from a container in an aircraft fire extinguishing system. The control head is hexagonal and is provided with an outlet fitting, a fill valve, an actuator body, a pressure switch and a pressure gauge. Each component can be threaded into any of the side faces or the end face of the control head so that the limited space available within the aircraft can be accommodated. An electrical detonator within the actuator body can be exploded to rupture a pair of frangible discs in succession. This opens a flow path for the extinguishant which is then discharged from the bottle to a delivery line which distributes it to the area of the fire. The detonator and its electrical heads are hermetically sealed in the actuator body to prevent contamination.

13 Claims, 2 Drawing Sheets

DISCHARGE CONTROL HEAD FOR AIRCRAFT FIRE EXTINGUISHANT CONTAINERS

BACKGROUND OF THE INVENTION

This invention relates in general to fire protection systems for aircraft and more particularly to an improved control head which controls the discharge of fire extinguishing agent from a container in an aircraft fire extinguishing system.

Patent application Ser. No. 324,698, filed Nov. 25, 1981 by William A. Enk et al discloses an electronic system for controlling an aircraft fire protection system. As described in the application, the fire extinguishant material is contained in a series of bottles which can be selectively discharged by operating contols on a cabin mounted control panel. A series of solenoid valves direct the extinguishant to the area of the aircraft in which the fire is present.

Discharge of each extinguishant bottle is controlled by a control head on the end of the bottle. An electrical detonator in the control head can be activated to cause the bottle to discharge extinguishant material into the fluid delivery lines of the system. The various types of control heads that have been proposed in the past for fire extinguishing systems are not well suited for use in aircraft systems, primarily because they are not designed specifically for aircraft applications. For example, the device shown in U.S. Pat. No. 4,126,184 to Hinrichs is used in a fire suppression system for a commercial or industrial building. There is no particular concern for space or weight requirements in the Hinrichs design because such buildings are not subject to the same space and weight limitations that form major factors in aircraft designs. Hinrichs provides only one configuration which in many cases would not fit in the area available on an aircraft. Furthermore, the Hinrichs device is not exposed to temperatures as high as those that are often encountered in aircraft systems.

In all known control heads having an electrical detonator, periodic replacement of the detonator is required to conform with prevailing safety standards. Since the detonator and related components such as electrical leads and connectors are exposed to the ambient air and thus to possible contamination which can cause the detonator to malfunction, its useful life is relatively short and replacement is required at regular intervals. Possible contamination of the detonator also increases the maintenance requirements and decreases the reliability of the system, especially after the detonator has been in service for an extended period of time. If the container should develop a leak permitting the extinguishant to escape, the leak can remain undetected and the container may completely discharge so that its contents are not available when needed. Another problem in existing systems is that inadvertent discharge of the extinguishant bottles can occur.

Typically, existing fire extinguishant systems for buildings simply discharge the extinguishing agent from the bottle through a pipe and nozzle without additional control, as shown in the Hinrichs 4,126,184 patent. Therefore, foreign materials in the extinguishant such as fragments from the exploding rupture disks do not present significant problems. However, in an aircraft system such as shown in the aforementioned Enk et al application, valves are included to direct the extinguishant to the area of the fire. Metal fragments and other solid matter in the flow lines can jam the solenoid valves and cause other malfunctions. Accordingly, filtering of the fluid upstream from each valve is necessary in order to assure proper operation of the valves.

SUMMARY OF THE INVENTION

The present invention provides an improved discharge control head for an extinguishant bottle in an aircraft fire extinguishing system. In accordance with the invention, the control head is hexagonal to present six flat faces on the sides and a flat end face. The control head is equipped with an outlet fitting, a fill valve and an actuator, each of which can be mounted on any of the control head faces. Consequently, if there is only limited space available on the aircraft for the extinguishant bottles, a configuration can be selected for each bottle which accommodates the available space. For example, if there is no space available beyond the end face of the control head, all of the components can be mounted on the side faces. Similarly, if one side of the control head is disposed against a wall or bulkhead or is otherwise restricted, all of the components can be mounted on the other side faces and/or on the end face of the control head.

Optional components such as a pressure switch or a pressure gauge can likewise be mounted on any of the faces of the control head. The hexagonal shape of the control head enhances its flexibility because each of the multiple faces can be drilled and threaded appropriately to receive the particular component that is to be connected with that face. The hexagonal shape also facilitates assembly because it readily accommodates a wrench.

Improved reliability and decreased costs are achieved by permanently mounting and sealing the actuator body to the control head and by encapsulating and hermetically sealing the electrical detonator in the actuator body. This prevents the detonator and associated parts from corrosion or otherwise being contaminated once installed and makes the detonator virtually maintenance free and unlimited in life. There is no need to periodically replace the detonator because it is permanently sealed against contamination and is electrically shielded. At the same time, the reliability of the detonator is enhanced because it is shielded from external contaminants. Also, the use of a pressure switch on the control head provides a visual indication in the event of leakage or other discharge of extinguishant from the bottle, and all empty bottles are individually identified on the control panel. As a result, routine preflight checks of the bottle availability can be carried out to improve the safety and operability of the system.

The control head and bottle assembly of the present invention is specially constructed for use in state of the art aircraft fire extinguishing systems such as that of the aforementioned Enk et al patent application. The assembly is lighter than conventional extinguishant bottles and can withstand higher temperatures (180° F. rating in comparison to 165° F. for conventional models). The bottle assemblies are also arranged to cooperate with other bottles in providing an overall system having considerable versatility. For example, a Y-shaped tube can be connected with two bottles to direct extinguishant from both bottles to a single valve which directs the extinguishant to the area of the fire. In this case, a screen filter is installed in the fluid line upstream from the valve so that metal fragments and other solid materials are filtered out of the extinguishing agent before reaching the valve. A single filter can serve two or more bottles in the various configurations that are possible.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
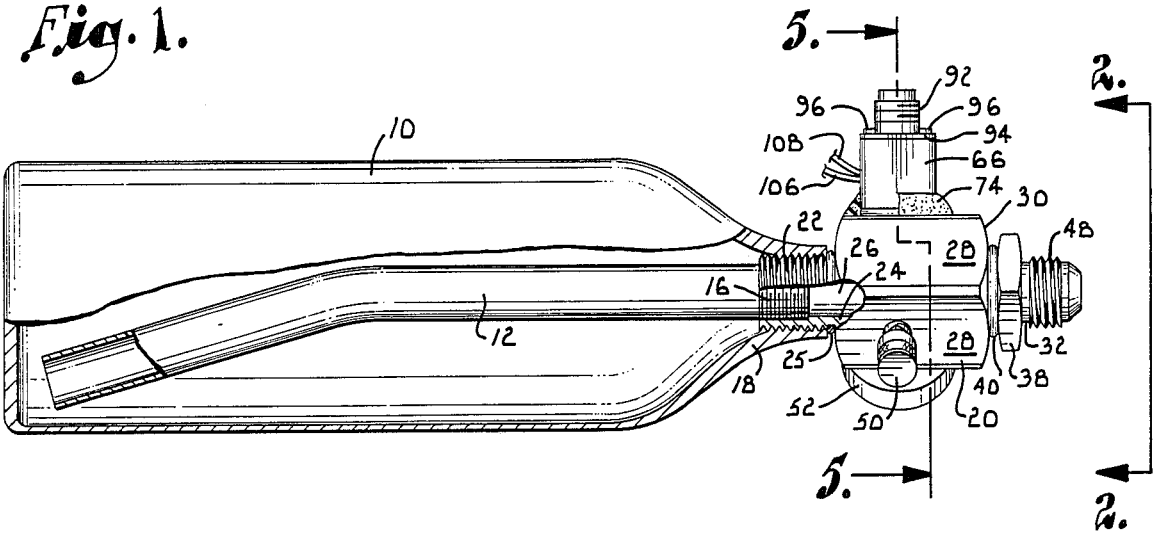
FIG. 1 is a side elevational view of an extinguishant bottle equipped with a discharge control head constructed according to a preferred embodiment of the present invention, with portions broken away for purposes of illustration.

Referring now to the drawings in more detail and initially to FIG. 1, numeral 10 generally designates a metallic bottle which forms a container for receiving and holding a fire extinguishing agent such as bromotrifluoromethane or another substance that is effective against fire. The extinguishing agent can be a liquid which is pressurized with a separate medium such as a liquified compressed gas. The bottle 10 is one of those used in an aircraft fire protection system of the type disclosed in patent application Ser. No. 324,698, filed Nov. 25, 1981 by William A. Enk et al, which is incorporated herein by reference. The bottle 10 is preferably constructed of a lightweight metal (such as aluminum) or composite materials which are capable of holding the extinguishing agent under pressure.

The bottle 10 is shown in a prone position, although it can be oriented upright or in any other desired position. The bottle 10 is equipped with a siphon tube 12 having an open end 14 near the bottom of the bottle and an externally threaded opposite end 16.

Opposite its bottom end, the bottle 10 has a neck portion 18 to which a hexagonal discharge control head 20 is connected. The neck 18 of bottle 10 is provided with internal threads 22 that mate with external threads formed on a short pipe 24 extending from one end of the control head 20. Pipe 24 is threaded into neck 18 in order to secure the control head 20 on the end of bottle 10. An O-ring 25 provides a seal between the bottle and control head. The pipe 24 is internally threaded so that the threads 16 on the siphon tube 12 can be threaded into it. The interior of the siphon tube 12 is thus connected with a passage 26 which begins in pipe 24 and extends axially through the control head 20.

Figure 2:
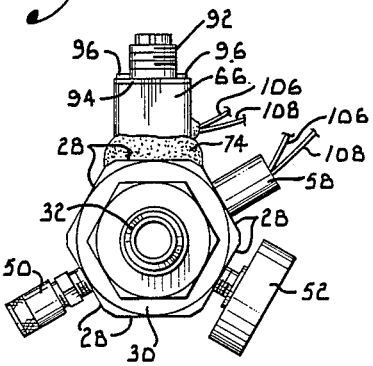
FIG. 2 is an end elevational view of the control head taken generally along line 2—2 of FIG. 1 in the direction of the arrow.

As best shown in FIG. 2, the hexagonal body of the control head 20 has six side faces 28 and a flat end face 30 on the end opposite the threaded pipe 24. The hexagonal shape of the control head 20 facilitates its installation in that a conventional wrench can be used to tighten it on the extinguishant bottle 10. Also, the various components of the control head can be mounted to the flat side faces 28 and to the flat end face 30 as will now be described.

Figure 6:
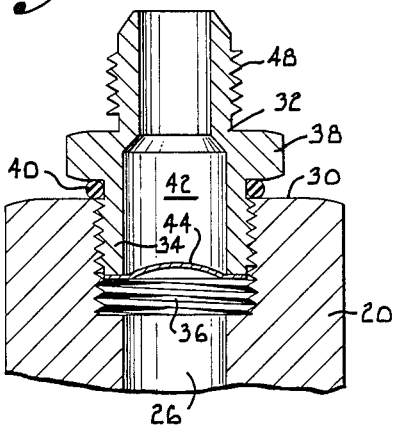
FIG. 6 is a fragmentary sectional view taken generally along line 6—6 of FIG. 5 in the direction of the arrows.

With particular reference to FIG. 6, an outlet fitting 32 has an externally threaded end 34 which is screwed into an internally threaded opening 36 formed in the flat end face 30 of the control head. The fitting 32 has an intermediate flange 38 which is preferably hexagonal or a similar shape in order to facilitate tightening of the outlet fitting with a wrench or other tool. An O-ring 40 is received on the outlet fitting 32 and is compressed against the end face 30 by flange 38 when the fitting is tightened, thereby sealing the outlet fitting to the control head. The opening 36 terminates at the end of the axial passage 26 which extends through the control head, as previously indicated.

An outlet passage 42 extends axially through the outlet fitting 32 and is closed at its inner end by a rupture disk 44 forming a frangible diaphragm. The rupture disk 44 is welded or otherwise secured across the end of fitting 32 in order to normally block the flow of extinguishing agent from passage 26 to the outlet passage 42. Preferably, the rupture disk is a concavo-convex member having score lines 46 (see FIG. 5) which provide areas of weakness. The rupture disk 44 is susceptible to rupture along the score lines 46 in order to minimize the fragmenting of the disk when it is ruptured.

The opposite or outer end of the outlet fitting 32 is externally threaded at 48 to facilitate connection with a delivery line (such as the lines shown at 122 and 124 in FIG. 7) of the aircraft fire extinguishing system. As shown in the aforementioned Enk et al application, the delivery line may lead to a manifold or to a valve which controls the extinguishant flow to the various areas of the aircraft.

Referring again to FIGS. 1 and 2 in particular, one of the side faces 28 of the discharge control head 20 is equipped with a fill valve 50. The fill valve is threaded into the face 28 and connects with the flow passage 26 of the control head. The extinguishant container 10 can be charged with extinguishant under pressure through the fill valve 50, as well known to those skilled in the art.

Another of the side faces 28 is equipped with a pressure gauge 52 which may be threaded into the face to communicate with the flow passage 26. The pressure gauge 52 may have a dial face 54 and a pointer 56 (see FIG. 3) which indicates on the dial face the internal pressure in the extinguishant bottle. The pressure gauge 52 is not always necessary and can be eliminated if desired.

Figure 9:
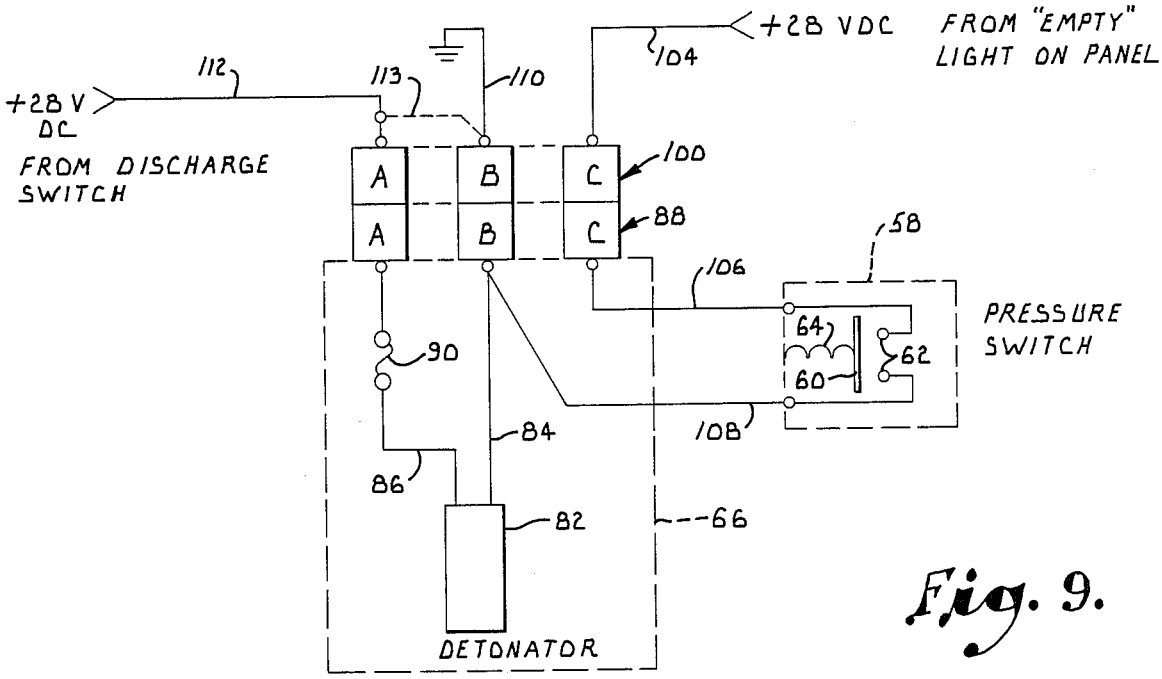
FIG. 9 is a schematic diagram of the electrical circuitry for the detonator and pressure switch of the control head.

Another of the side faces 28 is equipped with a pressure switch 58 having a body that may be threaded into the face 28 to communicate with the flow passage 26. As best shown in FIG. 9, the pressure switch 58 includes a switch element 60 which is continuously urged toward a pair of electrical contacts 62 by a spring 64 which is opposed by the pressure in the bottle. One face of the switch element 60 is exposed to the pressure in the flow passage 26, and the pressure in the bottle 10 is normally sufficient to overcome the force of the spring 64 so that the contacts 62 are normally open. However, if the pressure in the extinguishant bottle 10 is low enough, spring 64 closes the switch element 60 against the switch contacts 62. The pressure switch 58 is not required in all applications and may be eliminated in many cases. The switch can take the form of a snap action disk which snaps between positions at the set pressure.

Figure 5:
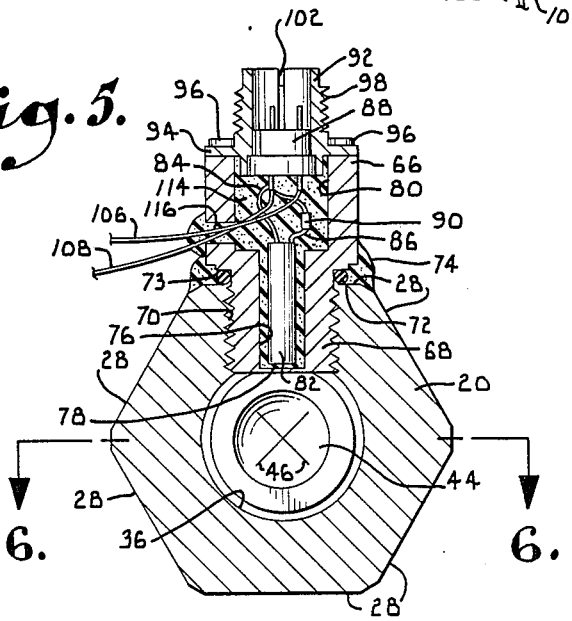
FIG. 5 is a fragmentary sectional view on an enlarged scale taken generally along line 5—5 of FIG. 1 in the direction of the arrows.

Mounted on another of the side faces 28 is an actuator body 66. As best shown in FIG. 5, the actuator body 66 has a reduced diameter neck portion 68 on one end which is externally threaded and screwed into an internally threaded opening 70 formed in the face 28 of the control head. The opening 70 extends from the exterior of the control head face 28 and leads to connection with the flow passage 26 at a location upstream from the rupture disk 44. The main part of actuator body 66 is located exteriorly of head 20 and is preferably square or hexagonal in section to facilitate tightening of the actuator body on the control head with a wrench or other tool. An O-ring 72 is compressed between the control head face 28 and a shoulder 73 on the actuator body 66 to provide a seal. In addition, urethane bond 74 or another suitable sealant material is applied to the joint between the actuator body 66 and the control head 20 in order to permanently mount and seal the actuator body on the control head.

An axial bore 76 is formed in the threaded portion 68 of the actuator body and is closed at its inner end by a frangible diaphragm or rupture disk 78. Alternatively, the rupture disk can be formed as a bottom part of the actuator body machined to the desired thickness. The rupture disk may be formed integrally on the inner end of the actuator body or may be formed as a separate rupture disk which is welded or otherwise secured to the actuator body. In either case, the rupture disk 78 is exposed on one side to the passage 26. Score lines (not shown) or other areas of weakness may be provided on the rupture disk 78. Disk 78 is considerably smaller than the primary rupture disk 44.

The bore 76 connects with a larger cavity 80 which is formed within the outer part of the actuator body 66. An electric detonator 82 is installed in the bore 76 on the side of disk 78 remote from passage 26. Disk 78 thus shields the detonator from the extinguishing agent. The detonator 82 has a pair of lead wires 84 and 86 which extend within the cavity 80 to connection with a plug 88. Lead 86 is equipped with a fuse 90.

Plug 88 is carried within a connector 92 having a flat flange 94. Screws 96 connect the flange 94 across the outer end of the actuator body 66. The connector 92 is externally threaded at 98 to receive a mating connector (not shown) having a socket 100 (FIG. 9) that mates with the lug 88. A key 102 properly orients the connectors so that the socket 100 will match with the correct pins of the plug in order to properly apply electric current to the detonator 82 and pressure switch 58.

The electrical system is shown in FIG. 9 and includes a conductor 104 which leads from the control panel to terminal C of the socket 100. Another conductor 106 leads from terminal pin C of the plug 88 to one of the normally open contacts 62 of the pressure switch 58. Extending from the other contact 62 is another conductor 108 which leads to connection with terminal pin B of plug 88. Pin B is grounded by a ground line 110 which connects terminal B of socket 100 with system ground.

The detonator leads 84 and 86 connect with terminal pins B and A, respectively, of plug 88. Terminal A of socket 100 connects with a conductor 112 which extends through the discharge switch on the control panel that is used to discharge the extinguishant bottle 10. The discharge switch is described in the aforementioned Enk et al application which likewise describes the indicator lights on the control panel which provide a visual indication when the bottle is empty. Line 104 connects through the indicator light with +28 volts DC, while line 112 connects through the discharge switch with +28 volts DC. Line 112 is a shielded wire. The metal shield is grounded at the B terminal of socket 100, as indicated by the broken line 113. The wire connects with terminal A.

Referring again to FIG. 5, silicone sealant 114 or a similar sealant material completely fills bore 76 and cavity 80 of the actuator body in order to encapsulate and hermetically seal the detonator 82 and its lead wires 84 and 86. An opening 116 is formed in one side of the actuator body 66 in order to accommodate the wires 106 and 108 which lead to the pressure switch 58. The silicone sealant 114 is applied through opening 116 after the actuator has been assembled and is applied in sufficient quantity to fill the opening 116, thereby assuring that the bore 76 and cavity 80 are completely filled. Alternatively, the sealant 114 can be applied from the top at the same time as the detonator is installed. When the connector is thereafter pushed into the body until flange 94 is in contact with body 66, the sealant is forced out all openings and around the wires 106 and 108.

In order to discharge extinguishant from the bottle 10, the discharge switch on the control panel is closed, and +28 volts DC is then applied to line 112 to complete the electrical circuit through the detonator 82. The detonation signal causes the detonator to fire and apply an explosive force to the adjacent rupture disk 78. Disk 78 is ruptured, and the explosive force is then applied to disk 44, causing it to rupture along the score lines 46. After disk 44 has been ruptured, the flow path is open and the pressure in the extinguishant bottle 10 forces the extinguishant to flow through the siphon tube 12, the flow passage 26 and the outlet passage 42 to the delivery line of the aircraft fire extinguishing system. The valves in the system then direct the extinguishing agent to the area of the fire.

The pressure switch 58 is normally open since the pressure within bottle 10 maintains the switch element 60 away from contacts 62. However, if the vessel is discharged or develops a leak permitting the extinguishant to leak out of the bottle, the drop in the pressure allows spring 64 to close the switch element 60. The circuit is then completed through the pressure switch, and the "empty" light on the control panel is energized to provide a visual indication that the bottle has been discharged and is no longer available to combat a fire. Each bottle has its own individual "empty" light on the control panel so that each unavailable bottle is indicated as such.

The electrical detonator 82 and its lead wires 84 and 86 are protected against contamination because they are hermetically sealed by the silicone sealant 114. Accordingly, there is no need for regular inspection and maintenance of the detonator, and there is no need to periodically replace the detonator since it is not exposed to the air or any other source of contamination which could cause it to malfunction. The actuator of the control head is thus virtually maintenance free and has an unlimited life.

The rupture disk 44 also serves as a pressure relief device which opens to release excess pressure from the bottle. The extinguishant which is then released flows through the normal distribution system which is able to safely handle the flow. The outlet assembly 32 thus serves two purposes: a safety device to relieve excessive pressure and the main valve which opens the bottle under control of the detonator.

Figure 3:
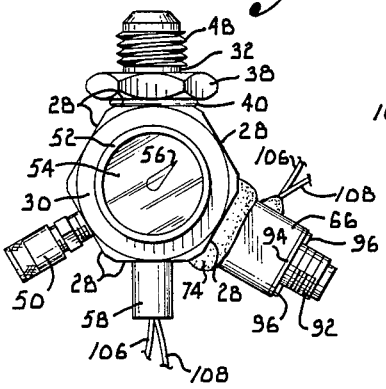
FIG. 3 is an end elevational view similar to FIG. 2 but showing the various components connected to different faces of the control head.
Figure 4:
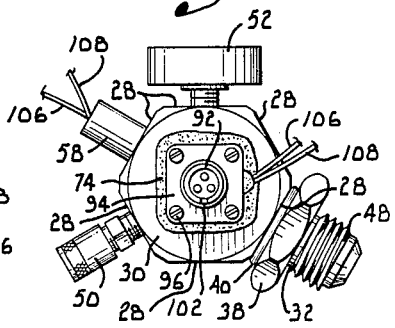
FIG. 4 is an end elevational view similar to FIGS. 2 and 3 but showing the various components connected to still different faces of the control head.

FIGS. 3 and 4 show alternative arrangements of the various components on the control head 20. The outlet fitting 32, the fill valve 50, the pressure gauge 52, the pressure switch 58, and the actuator body 66 can be mounted on any of the side faces 28 and/or the end face 30 of the control head. Consequently, virtually any desired configuration of the control head is possible. For example, if space limitations within the aircraft require the end face 30 to be disposed against or near a wall or bulkhead, then all of the components can be secured to the side faces 28. Similarly, if one or more of the side faces is restricted, all of the components can be mounted on the other, unrestricted side faces 28 and/or the end face 30. If the outlet fitting 32 is not mounted on the end face 30, the flow passage 26 extends through a right angle within the control head 20 in order to properly deliver extinguishing agent to the outlet of the control head.

Figure 7:
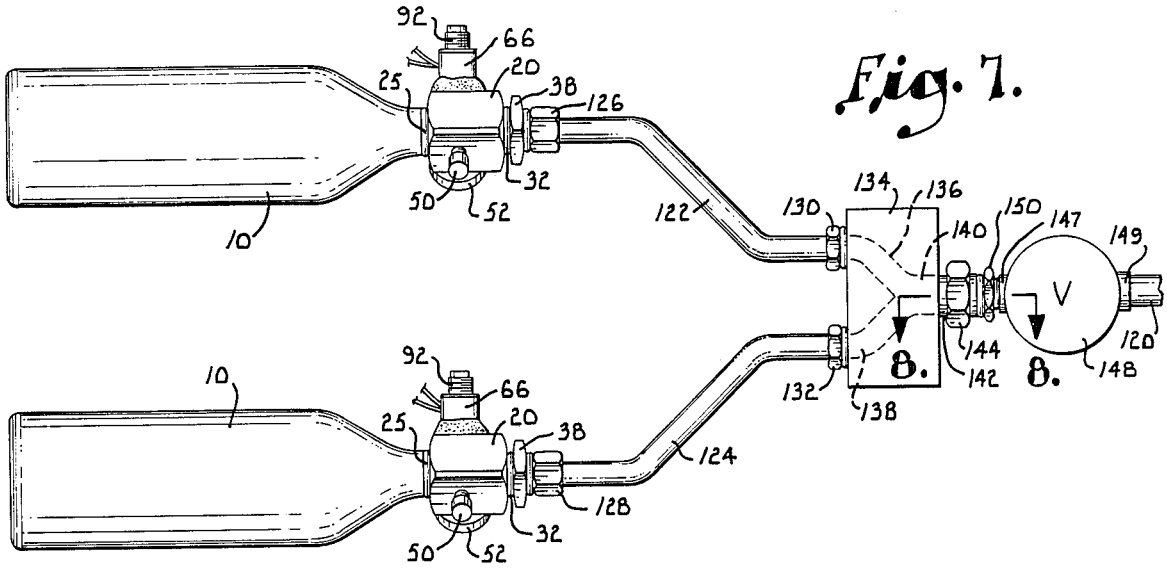
FIG. 7 is a side elevational view showing two extinguishant bottles connected with a single solenoid valve.

FIG. 7 shows an arrangement of two bottles 10 which connect with a single delivery line 120 of the aircraft fire extinguishing system. The outlet fittings 32 of the two control heads 20 connect with different conduits 122 and 124. The conduits 122 and 124 are equipped on one end with respective nuts 126 and 128 which are threaded onto the externally threaded portions 48 of the outlet fittings. The opposite ends of conduits 122 and 124 are connected by nuts 130 and 132 with the two inlets of a manifold block 134. The manifold block has internal passages 136 and 138 which merge into a single outlet passage 140 and cooperate with passage 140 to provide a Y shape. Conduit 122 connects with passage 136, and the other conduit 124 connects with the other passage 138. In this manner, the extinguishant flow from both bottles 10 is directed to the single passage 140.

Figure 8:
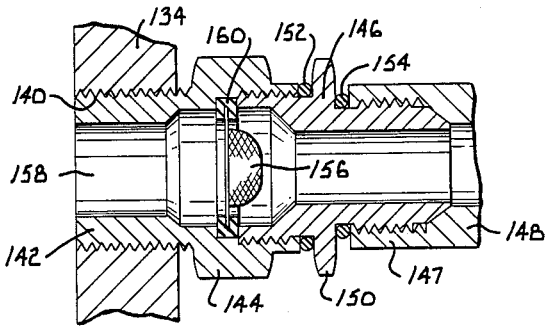
FIG. 8 is a fragmentary sectional view on an enlarged scale taken generally along line 8—8 of FIG. 7 in the direction of the arrows.

As best shown in FIG. 8, passage 140 is internally threaded in order to receive an externally threaded conduit 142 having an enlarged flange 144 to facilitate receipt of a wrench. The opposite end of conduit 142 is internally threaded in order to receive one end of a nipple 146. Threaded onto the opposite end of the nipple 146 is the inlet end 147 of a solenoid valve 148. The outlet end 149 of valve 148 connects with the delivery line 120, as shown in FIG. 7. The nipple 146 has an enlarged flange 150 which facilitates tightening with a wrench. O-rings 152 and 154 provide seals between the nipple and conduit 142 and the nipple and valve 148, respectively.

A screen filter 156 is secured within flange 144 across the flow passage 158 which extends from the manifold passage 140 to the valve 148. The screen 156 can have virtually any desired mesh, depending upon the size of the particles that must be filtered out of the extinguishing agent in order to prevent jamming of the solenoid valve 148. Secured to the periphery of screen 156 is an enlarged rim 160 which can be formed from a suitable sealing material. The rim 160 is compressed between one end of nipple 146 and an internal shoulder formed within flange 144. All of the agent flowing to valve 148 must first pass through the screen filter 156 which is located upstream from the valve.

The screen 156 prevents solid materials such as fragments from the rupture disks 44 and 78 from reaching the valve 148 and possibly jamming it. It is pointed out that only a single screen filter 156 is required to filter the extinguishant from both extinguishant bottles 10, and the cost is reduced in comparison to providing a screen for each bottle. It is to be understood that more than two bottles can be served by a single screen filter if such a configuration is desired. The screen 156 is cup shaped to increase its flow area. Thus, particles that lodge in the screen do not appreciably reduce the flow below what is allowed otherwise.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. Apparatus for holding fire extinguishing agent and applying the agent to a delivery line in an aircraft fire extinguishing system, said apparatus comprising:

an extinguishant container for installation in a predetermined area of the aircraft, said container being adapted to receive and hold a supply of the fire extinghishing agent under pressure;

a discharge control head having a plurality of generally planar side faces and a generally planar end face, said control head presenting a flow passage disposed in communication with the interior of said container to receive extinguishing agent therefrom;

an outlet fitting for the control head having an outlet passage providing communication between said flow passage and the delivery line of the aircraft fire extinguishing system;

a first frangible diaphragm in said outlet fitting providing a barrier in said outlet passage blocking the flow of agent therethrough;

a fill valve for connection with said control head to permit the charging of said container with extinguishing agent;

an actuator body having a bore;

a second frangible diaphragm in said actuator body sealing said bore from said flow passage;

said outlet fitting, fill valve and actuator body all being adapted for connection with each of said faces of the control head to permit the faces of the control head to which said fitting, valve and actuator body are connected to be selected to accommodate the space available in said predetermined area of the aircraft;

a detonator in said bore of the actuator body located on a side of said second diaphragm opposite the side exposed to said flow passage, said detonator being selectively operable to apply an explosive force for rupturing said second diaphragm and then said first diaphragm, whereby the pressure in said container forces the extinguishing agent through said flow passage and outlet passage to the delivery line of the aircraft fire extinguishant system; and a quantity of sealant material substantially filling said bore of the actuator body to encapsulate and hermetically seal said detonator.

2. Apparatus as set forth in claim 1, including a pressure gauge for visually indicating the pressure in said container, said gauge being adapted for connection with each of said faces of the control head.

3. Apparatus as set forth in claim 1, including:

a second container for installation in the aircraft, said second container being adapted to receive and hold a supply of fire extinguishing agent under pressure;

a second discharge control head on said second container for controlling the discharge of agent therefrom, said second control head presenting a second flow passage disposed in communication with the interior of said second container and terminating a communication with a normally closed second outlet passage;

means for selectively opening said second outlet passage to effect flow of agent from said second container through said second flow passage and said second outlet passage;

first and second conduits connected at one end with the respective first and second outlet passages and at another end with a third conduit, whereby agent from each of the first and second containers is directed into said third conduit;

a valve disposed between said third conduit and the delivery line of the aircraft fire extinguishing system for controlling the flow of extinguishing agent therebetween; and a filter element in said third conduit for filtering solid materials from the extinguishing agent at a location upstream from said valve.

4. Apparatus for applying fire extinguishing agent to a delivery line in an aircraft fire extinguishing system, said apparatus comprising:

a container for receiving and holding a supply of the fire extinguishing agent under pressure;

a discharge control head on said container for controlling the discharge of agent therefrom, said control head having a flow passage disposed in communication with the interior of the container to receive extinguishing agent therefrom;

an outlet on said control head in communication with said passage, said outlet being adapted for connection with the delivery line of the aircraft fire extinguishing system;

a first frangible diaphragm in said passageway providing a barrier blocking the flow of extinguishing agent from said container to said outlet;

an actuator body connected with said control head at a location offset from said outlet, said actuator body having a bore communicating with said flow passage;

a second frangible diaphragm in said bore having one side exposed to said passage and another side remote therefrom;

a detonator in said bore located adjacent said second diaphragm on said remote side thereof, said detonator being operable upon receipt of a detonation signal to provide an explosive force for rupturing said second diaphragm and then said first diaphragm, whereby the pressure in said container forces the extinguishing agent through said passage and outlet for distribution by the delivery line to combat fire on the aircraft;

means for selectively applying a detonation signal to said detonator;

a first quantity of sealant material sealing and permanently connecting said actuator body to said control head; and a second quantity of sealant material substantially filling said bore of the actuator body to encapsulate and hermetically seal said detonator.

5. Apparatus as set forth in claim 4, including:

pressure switch means for sensing the pressure in said container; and indicating means for providing a signal when the sensed pressure is below a predetermined level indicative of the absence of extinguishing agent in the container.

6. Apparatus as set forth in claim 5, wherein:

said detonator is electrically activated and includes an electric detonation circuit for activating the detonator to provide said explosive force when the detonation circuit is completed; and said detonation signal applying means acts to complete said detonation circuit.

7. Apparatus as set forth in claim 6, wherein said pressure switch means includes a second electric circuit and a pressure switch acting to complete said second circuit when the sensed pressure in the container is below said predetermined level, said indicator means acting to provide said signal upon completion of said second circuit.

8. Apparatus as set forth in claim 7, wherein:

said actuator body has electrical terminals for applying power to said detonation circuit and said second circuit;

said detonation circuit includes wiring electrically coupling said terminals with said detonator; and said second circuit includes wiring electrically coupling said terminals with said pressure switch.

9. Apparatus as set forth in claim 8, including a side portion of said actuator body located exteriorly of said control head and presenting an opening through which said wiring of said second circuit extends.

10. Apparatus for holding fire extinguishing agent and applying the agent to a delivery line in an aircraft fire extinguishing system, said apparatus comprising:

an extinguishant container for installation in a predetermined area of the aircraft, said container being adapted to receive and hold a supply of the fire extinguishing agent under pressure;

a discharge control head having a plurality of generally planar side faces and a generally planar end face, said control head presenting a flow passage disposed in communication with the interior of said container to receive extinguishing agent therefrom;

an outlet fitting for the control head having an outlet passage providing communication between said flow passage and the delivery line of the aircraft fire extinguishing system;

a first frangible diaphragm in said outlet fitting providing a barrier in said outlet passage blocking the flow of agent therethrough;

a fill valve for connection with said control head to permit the charging of said container with extinguishing agent;

an actuator body having a bore;

a second frangible diaphragm in said actuator body sealing said bore from said flow passage;

said outlet fitting, fill valve and actuator body all being adapted for connection with each of said side faces and with said end face of the control head to permit the side and end faces of the control head to which said fitting, valve and actuator body are connected to be selected to accommodate the space available in said predetermined area of the aircraft; and a detonator in said bore of the actuator body located on a side of said second diaphragm opposite the side exposed to said flow passage, said detonator being selectively operable to apply an explosive force for rupturing said second diaphragm and then said first diaphragm, whereby the pressure in said container forces the extinguishing agent through said flow passage and outlet passage to the delivery line of the aircraft fire extinguishing system.

11. Apparatus as set forth in claim 10, including a pressure switch for sensing the agent pressure in said container and providing a signal when the pressure drops below a preselected pressure indicative of the absence of extinguishing agent in the container, said pressure switch having a body adapted for connection with each of said faces of the control head.

12. Apparatus as set forth in claim 11, including a pressure gauge for visually indicating the pressure in said container, said gauge being adapted for connection with each of said faces of the control head.

13. Apparatus as set forth in claim 10, wherein said outlet fitting, fill valve and actuator body each has a threaded connection with the face of said control head to which it is connected.

* * * * *